175-240 SR
4/7/81 XR 4,260,030

United States Patent [19]
Fox

[11] 4,260,030
[45] Apr. 7, 1981

[54] WELL TOOL

[75] Inventor: Fred K. Fox, Houston, Tex.

[73] Assignee: Engineering Enterprises, Inc., Houston, Tex.

[21] Appl. No.: 49,458

[22] Filed: Jun. 18, 1979

[51] Int. Cl.[3] ..... E21B 4/02; F03B 13/02; E21B 12/02

[52] U.S. Cl. ..... 175/107; 175/40; 415/502

[58] Field of Search ..... 175/107, 39, 40, 228, 175/320; 415/502, 118, 146

[56] References Cited

U.S. PATENT DOCUMENTS

| | | | |
|---|---|---|---|
| 2,626,780 | 1/1953 | Ortloff | 175/107 |
| 2,967,577 | 1/1961 | Tiraspolsky | 175/107 |
| 3,159,222 | 12/1964 | Hammer et al. | 415/502 X |
| 3,220,244 | 11/1965 | Donnelly | 415/118 X |
| 3,456,746 | 7/1969 | Garrison et al. | 175/107 X |
| 3,971,450 | 7/1976 | Fox | 415/502 X |
| 4,019,591 | 4/1977 | Fox | 175/228 X |
| 4,114,704 | 9/1978 | Maurer et al. | 175/107 |

*Primary Examiner*—Stephen J. Novosad
*Attorney, Agent, or Firm*—Marvin B. Eickenroht; Jennings B. Thompson

[57] ABSTRACT

There is disclosed a turbodrill wherein excessive wear on the axial thrust bearing supporting the shaft from the housing is detectable at the surface by means of an increase in the back pressure of the drilling fluid circulating through the turbine section.

29 Claims, 8 Drawing Figures

Fig. 2A
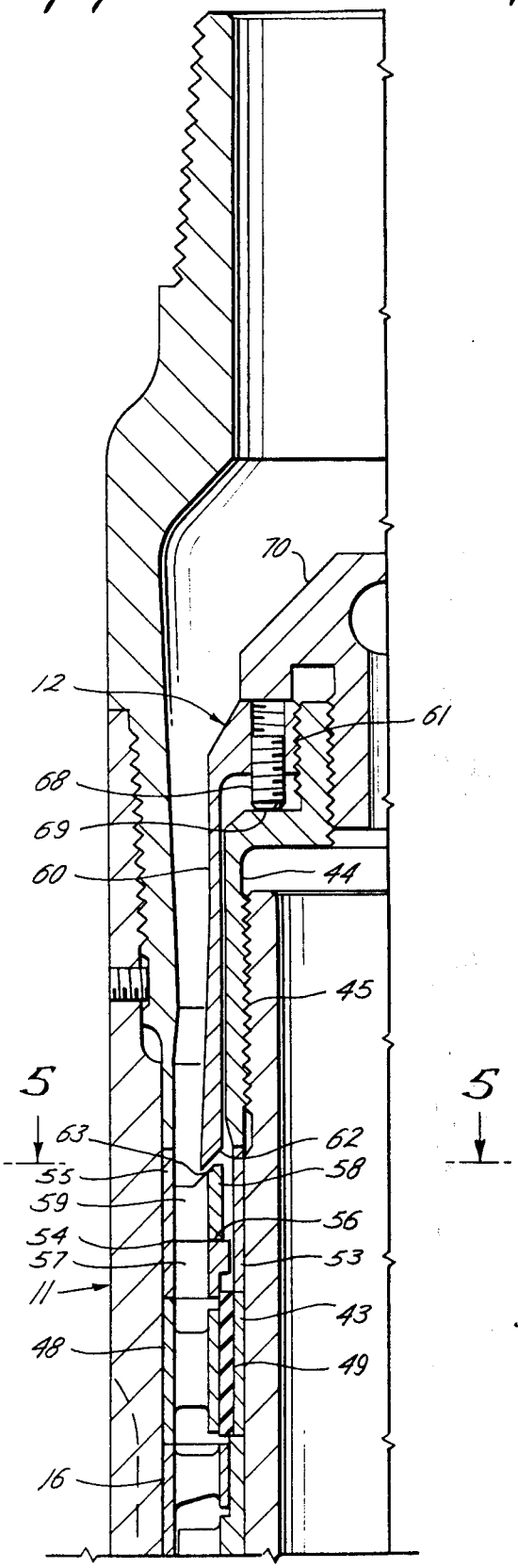
Fig. 2B
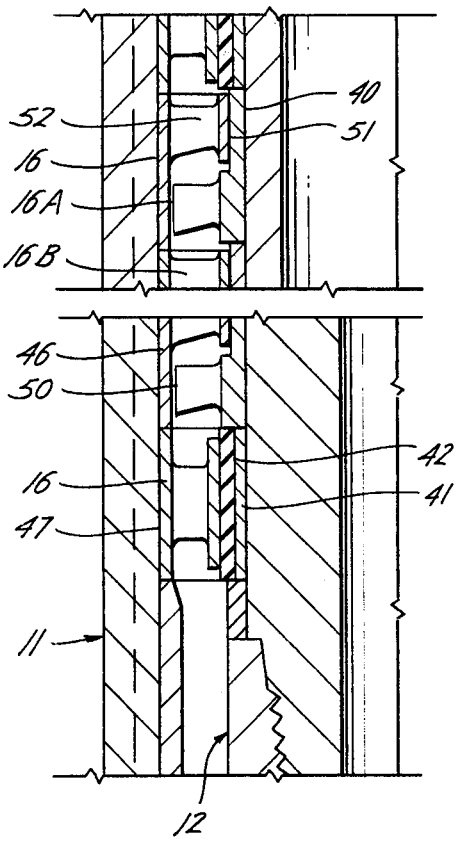
Fig. 3
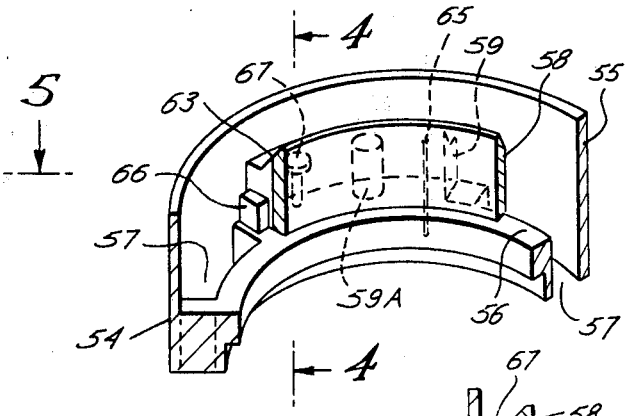
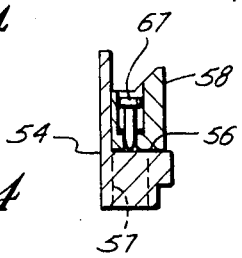
Fig. 4

WELL TOOL

This invention relates generally to well tools of the type having a body connectible as part of a well string and including inner and outer members which define an annular flow path between them, and an axial thrust bearing carried by one of the members to support the other member for relative rotation with respect thereto. More particularly, it relates to improvements in tools of this type having elements, such as the rotors and stators of a turbodrill, which are susceptible to damage in the event of excessive bearing wear.

In a turbodrill, a shaft having a bit at its lower end is rotatably mounted within an outer housing by means of an axial thrust bearing carried by the housing which is suspended from the lower end of a drill string. A turbine section is located within an annular space between the shaft and housing so that drilling fluid circulating through the space rotates the shaft on which the rotors are carried with respect to the housing on which the stators are carried. In Pat. No. 3,971,450, individual rotors are stacked one above the other about the outer diameter of the shaft, and individual stators are stacked one above the other within the inner diameter of the housing. More particularly, the rotors have inner walls which are arranged in end-to-end relation about the shaft, and the stators have outer walls which are arranged in end-to-end relation within the housing. Normally, the rotor and stator blades carried by these walls are vertically spaced apart uniform distances which prevent them from interfering with one another. However, if the thrust bearing wears to such an extent that the rotor blades drop with the shaft a sufficient amount to interfere with the stator blades, these expensive elements may become so damaged as to require their replacement.

An object of this invention is to provide a well tool of this type in which an operator at the surface is automatically warned of bearing wear which approaches an excessive amount, so that he may pull the tool from the well before damage occurs.

Another object of this invention is to provide a well tool of this type which is especially well suited for use as a turbodrill having rotors and stators assembled in the manner of the above-mentioned patent.

These and other objects are accomplished, in accordance with the illustrated embodiment of the invention, by a well tool of the type described having a first part which is carried by the supporting member for rotation with it and which has at least one opening therethrough which forms a continuation of the flow path between the members, and a second part having at least one opening therethrough and mounted on the first part for relative rotation with respect to it between first and second positions. In the first position of the second part, its opening is aligned with the opening in the first part to permit unobstructed flow through an annular space between the members, and, in its second position, such part at least partially obstructs flow therethrough to cause a change in back pressure of fluid circulating through the string which may be detected at the surface. In the illustrated embodiment of the invention, such second part has one or more restricted holes therethrough each of which is aligned with the opening in the first part, when the second part is in its second position, to permit only restricted flow through the annular space, and thus permit circulation of fluid to be continued through the annular space.

More particularly, a third part which is carried by the supported member for rotation with it has a lower surface which is normally spaced above an upper surface of the second part a vertical distance less than the supported member is free to move downwardly relative to the supporting member, upon wear of the bearing, without damage to the tool. Thus, in response to this predetermined amount of wear on the bearing, the lower surface moves downwardly into engagement with the upper surface so as to cause the second part to rotate with the third part, and thereby rotate said second part with respect to the first part from its first to its second position. Means are also provided for locating the second part in its second position, automatically in response to its movement into such position, whereby the opening in the second part is held out of alignment with the opening in the first part, and the restricted hole is maintained in alignment therewith so as to provide a continuing indication to an operator at the surface of impending excessive bearing wear.

In the illustrated embodiment of the invention, the second part is so located in the second position by means of a stop on the upper side of the first part which is received within an opening in the second part in position to engage one end of the opening as the second part moves into such second position. Also, a pin is carried by the second part in position to drop into the opening in the first part, as the supported member rotates into its second position, to prevent relative movement of the second member from its second back to its first position. The second part is initially located in its first position by means which is releasable automatically in reponse to relative rotation between the first and second parts following engagement of the upper and lower surfaces. In the illustrated embodiment of the invention, this releasable means comprises a shear pin connecting the first and second parts.

As also illustrated in the drawings, each of the first and second parts comprises a ring guidably rotatable within the annular space between the members, and each ring has a plurality of openings therein alignable with a corresponding number of openings in the other ring. More particularly, the cross-sectional area through the openings in their first position is approximately equal to the smallest cross-sectional area of the remainder of the flow path so as to avoid obstructing flow in such first position. In the second position of the second part the openings in the first part are covered by portions of the second part which are solid except for the restricted holes therethrough, which, as previously noted, permit circulation through the annular space to be continued while restricting flow to the extent necessary to provide the desired indication of increased pressure.

Preferably, a means is provided for adjusting the spacing between the upper and lower surfaces on the third part and the second ring. Also, the upper and lower surfaces are conically shaped so as to wedge against one another upon continued bearing wear, thereby causing them to engage even more tightly so as to insure rotation with one another.

In its illustrated embodiment, the well tool is a turbodrill which, as previously described, comprises a body including a housing adapted to be suspended from the lower end of a drill string, and a shaft adapted to suspend a bit from its lower end and arranged within the housing to define an annular space between them. The axial thrust bearing is carried by the housing to support the shaft for rotation with respect to it, and a turbine section within the annular space includes a series of stators carried by the housing for rotation therewith and a series of stators carried by the shaft for rotation therewith. As also previously described, and as as shown in U.S. Pat. No. 3,971,450, individual stators and rotors are stacked one above the other in spaced relation. The lower surface on the third part carried by the shaft is normally spaced above the upper surface of the second ring a vertical distance less than the maximum spacing between adjacent rotor and stator elements, so that, as also previously discussed, the operator is able to detect bearing wear before it reaches a point at which the stator and rotor elements would interfere with one another.

As shown in U.S. Pat. No. 3,971,450, the stators have outer walls which are stacked in end-to-end relation, and the first ring has an outer wall whose lower end is stacked above the end wall of one of the stators. The openings in the first ring are formed in a ledge which extends inwardly from its outer wall and over which the second ring is slidable, and the stop on the first ring is mounted on the ledge in position to be received in one of the openings in the second rings. The pin carried by the second ring is moveable vertically between a raised position in which its lower end slides over the ledge of the first ring and a lower position in which its lower end drops into an opening in the ledge as the second ring moves into its second position.

The part on which the lower surface is formed comprises a sleeve which surrounds the shaft and which is threadedly connected thereto to permit such lower surfaces to be vertically adjusted toward and away from the upper surface of the second ring. More particularly, the shaft comprises a main body about which the stators are stacked and a skirt threadedly connected to the main body to move the lower end against the upper end of the stack of stators in order to hold them in place about the main body of the shaft. The sleeve is threadedly connected to the skirt in surrounding relation thereto, and a screw carried by the sleeve is moveable downwardly into engagement with a portion of the skirt so as to prevent vertical movement of the sleeve out of its adjusted position.

In the drawings, wherein like reference characters are used throughout to designate like parts:

FIG. 2A is an enlarged vertical sectional view of one side of the upper end of the turbodrill of FIG. 1, including the upper end of the turbine section thereof and the means for detecting excessive wear on an axial thrust bearing supporting the shaft from the housing thereof;

FIG. 2B is another vertical sectional view of one side of the turbodrill including vertically interrupted intermediate and lower end portions of the turbine section;

FIG. 3 is a partial perspective view of the first and second rings of the means for detecting such wear, with the second ring in its firt position to permit unobstructed flow through the openings of the first and second rings;

FIG. 4 is a vertical sectional view of the rings of FIG. 3, as seen along broken lines 4—4 thereof;

Figure 1:
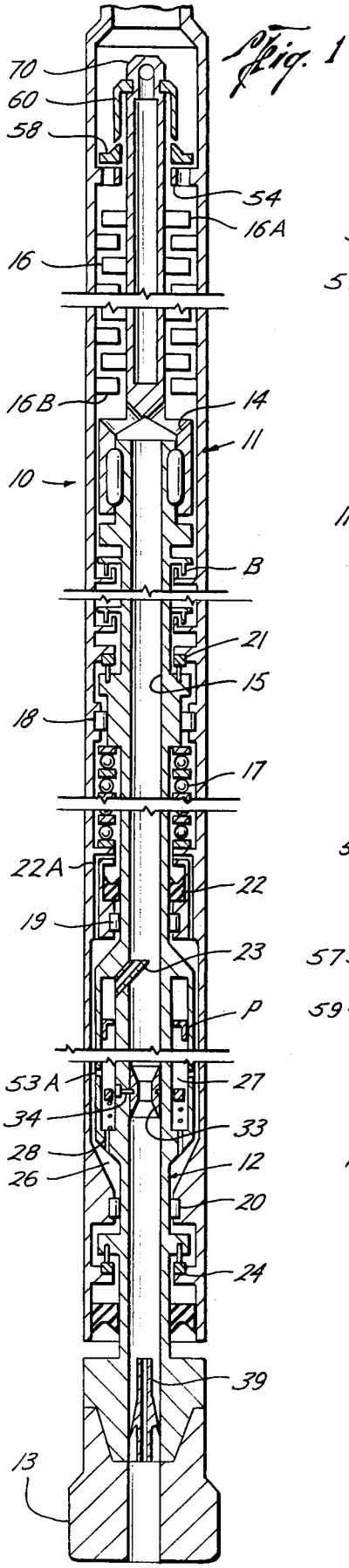
FIG. 1 is a vertical sectional view of a turbodrill constructed in accordance with the present invention, such turbodrill being discontinued at different levels along its length for purposes of clarity.

With reference now to the details of the above-described drawings, the overall turbodrill, which is indicated in its entirety by reference character 10, is shown in FIG. 1 to comprise a housing or case 11 having its upper end adapted to be connected to the lower end of the drill string (not shown), and a shaft 12 mounted for rotation within the case 11 and supporting a bit 13 at its lower end. Thus, the case and shaft constitute relatively rotatable outer and inner members which make up a body extending from connection of the upper end of the case with the drill string to connection of the lower end of the shaft with the bit.

As well known in the art, the tool is lowered on the drill string into a well bore, and drilling fluid is circulated downwardly through the drill string and the tool, out the lower end of bit 13, and upwardly within the annulus between the tool and the well bore. As shown in FIG. 1, ports 14 connect an annular space between the upper end of the shaft and the case with a bore 15 through the shaft connecting at its lower end with a bore through bit 13. Thus, the case and shaft form a passageway through the body of the tool 10 connecting the well string with the bore.

In the illustrated tool, shaft 12 is rotated with respect to case 11, so as to impart rotation to bit 13, by means of a turbine section 16 comprising stators 16B on the inner diameter of the case, and cooperating rotors 16A on the outer diameter on the upper end of the shaft 12 within the annular space above ports 14 in the shaft. As previously described, the shaft and thus the bit 13 are caused to rotate in response to the circulation of drilling fluid downwardly through the turbine section 16.

The portion of the shaft 12 below ports 14 is spaced from the case 11 to provide an annular space in which bearings are received for supporting the shaft from the case. As shown in FIG. 1, these bearings include axial thrust bearings 17 in the form of balls mounted as an assembly between a downwardly facing shoulder on the shaft and an upwardly facing shoulder on the case, as well as radial bearings 18, 19 and 20 in the form of rollers carried by the case for rotation about vertical axes. As shown in FIG. 1, the bearings are contained within a lubricant chamber 26 within the space formed between upper and lower seals 21 and 24 sealing between the case and shaft, the thrust bearings 17 and upper radial bearings being separated from the remainder of the lubricant chamber beneath them by a seal 22.

Both seals 21 and 24 are so-called "face" types of well known construction, but reversed end for end with respect to one another so that upper seal 21 is arranged to prevent flow therepast in an upward direction and lower seal 24 is arranged to prevent flow therepast in a downward direction. The lower seal 22 comprises one or more cup-type sealing rings of resilient material having upwardly diverging lips on their inner and outer diameters, which permit flow therepast in an upward direction, but prevent it in a downward direction. One or more passageways 22A are formed in the case to connect with the lubricant chamber 26 above and below seal 22, and a check valve (not shown) in each such passageway prevents flow therethrough in an upward direction, but permits flow therethrough in a downward direction, to bypass seal 22, when the pressure in the portion of the chamber above seal 22 exceeds that below it by a predetermined amount.

An annular space is formed within the shaft to provide a reservoir 27 from which lubricant may be supplied to the lubricant chamber. The lower end of the reservoir is connected to the lubricant chamber by one or more ports 28, and a tube 23 connects the bore through the shaft with the upper end of the reservoir. Thus, drilling fluid above seal 21 and below seal 22 is ordinarily at substantially the same pressure, and the differential pressure between drilling fluid on the inside and outside of the tool is taken across the lower seal 24, so that a leak from the lubricant chamber will ordinarily first occur at its lower end—i.e., at seal 24.

The drilling fluid contains relatively heavy particles, such as barite and sand, which may be caused to settle out due to the inertia imparted to them by vibration of the tool. Even though seal 21 may not have to hold a large pressure differential across it, it may nevertheless be damaged to such an extent as to permit lubricant to escape from the bearing chamber if these particles are allowed to lodge between the sealing surfaces. It is therefore preferred to protect seal 21 from the drilling fluid by means of a column of high density grease which, as described in my eariler U.S. Pat. No. 4,019,591, may have particles of metal of a high specific gravity dispersed therein to raise the specific gravity of the grease above that of the drilling fluid. As illustrated diagrammatically in FIG. 1, the column of heavy grease may be contained in a series of vertically stacked buckets B which impede passage of the particles which might settle out of or through the grease into the lower end of the column and thus onto seal 21.

An annular piston P is sealably slidable within reservoir 27 to separate the upper level of lubricant therein from drilling fluid admitted to the reservoir from bore 15 of the shaft through tube 23. The drilling fluid constantly urges the piston in a downward direction so that if lubricant leaks past seal 24 and out of the lubricant chamber, additional lubricant is supplied thereto from the reservoir. Inasmuch as tube 23 extends upwardly as well as inwardly, it has a pitot tube effect to insure that drilling fluid is applied to the piston at a pressure slightly higher than that which acts over the upper end of seal 21.

As lubricant is supplied from the reservoir to the lubricant chamber, piston P gradually moves downwardly. Although FIG. 1 is discontinuous intermediate the length of the reservoir, it (the reservoir) may be of considerable length. However, when piston P approaches the lower end of the reservoir, a means is provided for indicating to the operator at the wellhead that this level has been reached, and thus that continued use of the tool runs the risk of damaging the bearings, so that the operator may discontinue circulation and pull the tool from the well bore.

This indicating means comprises a sleeve 33 received within the bore 15 of the shaft with its outer diameter fitting closely within the bore. The sleeve 33 is held in an upper position (FIG. 1) within the bore by means of one or more retainer pins 34 extending through holes in the shaft connecting its bore with the reservoir portion 27. Each pin is shiftable between an inner position in which its inner end fits within an annular groove about the sleeve to hold the sleeve in the position of FIG. 1, and an outer position in which the pin is withdrawn from the groove to permit the sleeve to move downwardly to a position within the lower end of the bore.

Inasmuch as the sleeve is relatively thin, it provides a minimum of obstruction to flow through the bore 15 of the shaft when supported in the upper position of FIG. 1. When it is released, sleeve 33 falls downwardly into an annular opening of a spider 39 threadedly connected within a lower portion of the bore. When the sleeve is so received, it diverts all flow through a central opening in the spider which is of considerably lesser cross-sectional area than that through the sleeve so as to cause a noticeable increase in the pressure of the drilling fluid which may be observed by the operator at the wellhead. Since copending application, Ser. No. 033,554, filed by Fred K. Fox, on Apr. 27, 1979, and assigned to the assignee of the present application, describes in detail the manner in which sleeve 33 is released in response to the downward movement of piston P, reference may be made to such other application for a full understanding thereof.

As also shown in FIG. 1, and described in the aforementioned pending application, a port 53A formed in the side of reservoir 27 is uncovered by piston P as the piston moves to a position (not shown) to release sleeve 33. Thus, until the circulation of the drilling fluid is discontinued, high pressure drilling fluid bypasses the reservoir to flow into the lubricant chamber 26, from which it will ordinarily flow out of the tool past lower seal 24, which is the most susceptible to wear. This then prevents the pressure differential between the drilling fluid inside and outside of the tool from acting over upper seal 21, so that, with seal 22 disposed beneath thrust bearings 17 they, together with upper bearing 18, are in any event protected from the drilling fluid. That is, only bearings 19 and 20 may be damaged by any drilling fluid which enters the annular chamber 26.

As shown, each rotor 16A comprises an inner wall 40 which fits closely about the shaft 12 within the turbine section 16, and these inner walls are stacked one above the other. Thus, the lowermost rotor is stacked above a spacer 41, which, as shown in FIG. 2B, is supported on a shoulder about the shaft and is surrounded by a radial bearing sleeve 42, while the uppermost rotor is held down by a spacer 43 which is surrounded by a bearing sleeve 49 and held down by means of a skirt 44 threadedly connected at 45 to the upper end of the main body of the shaft 12.

Each stator 16B includes an outer wall 46 which fits closely within the inner diameter of the housing within the turbine section 16, and these outer walls of the stators are stacked one above the other. Thus, the lowermost outer wall is stacked above the outer wall of a spacer 47 surrounding bearing sleeve 42 and supported on a shoulder within the housing (FIG. 2B), and the uppermost outer wall is held down by a spacer 48 surrounding bearing sleeve 49. Spacer 48 is in turn held down by the first and second rings of the bearing wear detecting means, as will be described to follow.

Assembly of the rotors and stators, as described, enables them to be held for rotation with the shaft and housing, respectively. If desired, additional means may be employed for holding the rotors fast on the shaft, and the stators fast on the housing, particularly in use in a well. For example, they may be made of materials having different coefficients of expansion.

Each rotor 16A includes circumferentially spaced-apart blades 50 extending radially outwardly from the outer diameter of the lower portion of inner wall 40. Each stator 16B includes an outer wall 51 which is slidably received about the outer diameter of the upper portion of each inner wall 40 of each rotor 16A, and the circumferentially spaced blades 52 of each stator extend radially between the inner and outer walls. As shown by the broken away portion of FIG. 7, the rotor and stator blades are generally cup shaped and face in opposite directions in forming water courses through adjacent rows of rotors and stators.

Figure 7:
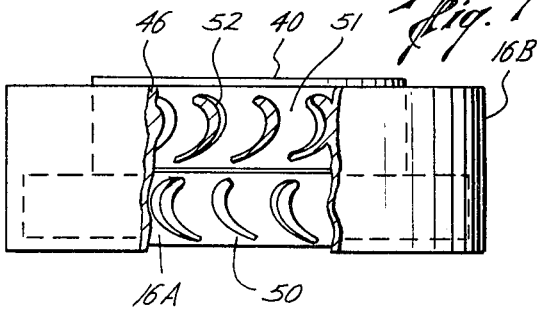
FIG. 7 is a side view of adjacent rotors and stators, with the rotor broken away in part to show the rotor and stator blades thereof.

As shown in FIG. 7, as well as can be seen from FIGS. 2A and 2B, when assembled, the rotor and stator blades are vertically spaced from one another so as to avoid interference during relative rotation between them. However, upon wear of the axial thrust bearings supporting the shaft from the housing, the stacked rotors will move downwardly relative to the stacked stators, and, as previously described, it is the purpose of the bearing wear detecting means to be described to follow to indicate to an operator at the surface that the bearings have worn to such an extent that this interference will occur unless operation of the turbodrill is discontinued, and the turbodrill pulled from the well to replace the worn bearing.

The detecting means includes a first ring 54 having an outer wall 55 which fits closely within the inner diameter of the housing and whose lower end is stacked above the spacer 48. The upper end of wall 55 of ring 54 is engaged by the lower end of an upper threadedly connected part of the case, as shown in FIG. 2A, so that like the stators, ring 54 is mounted in the housing in such a manner that it is held against rotation with respect thereto.

Ring 54 also includes a ledge 56 which extends radially inwardly from wall 55 and has a series of circumferentially spaced-apart openings 57 formed therein. The total area of these openings at least approximates the total open area through the water courses provided within the turbine section, so that when the openings 57 are unobstructed, there is no obstruction to flow through the turbine section. The inner diameter of the ledge 56 is spaced somewhat from a spacer 53, which is stacked above spacer 43, and in turn held down by the lower end of skirt 45, as shown in FIG. 2A. Thus, there is no interference with free rotation between the shaft and housing.

Figure 5:
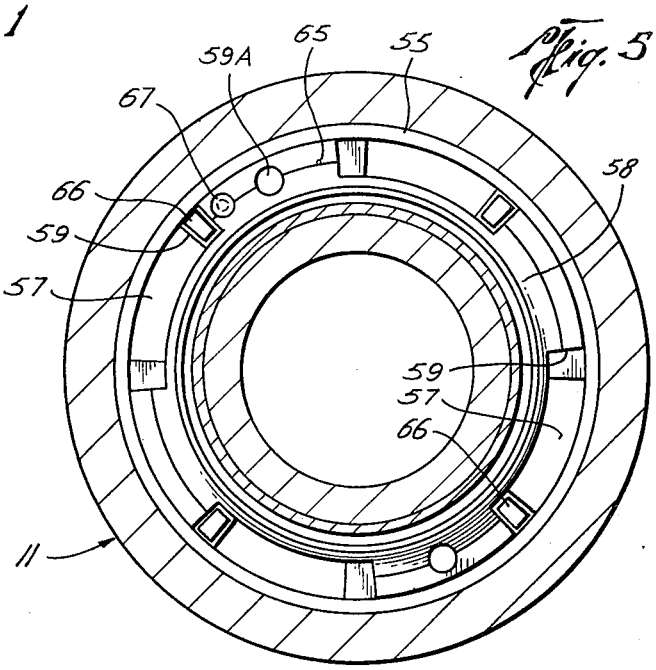
FIG. 5 and 6 are cross sectional views of the turbodrill, as seen along broken lines 5—5 of FIG. 2A, FIG. 5 showing the second ring in its first position of FIG. 3 and FIG. 6 showing it in its second partially obstructing position.
Figure 6:
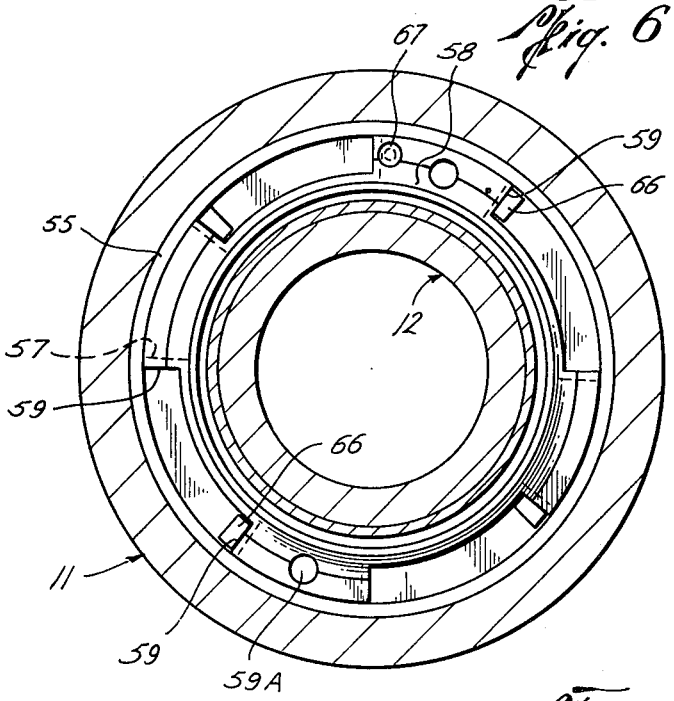

The second ring 58 of the detecting means has a lower surface which is mounted upon the upper surface of ledge 56 for rotatably sliding with respect to the first ring. A series of circumferentially spaced-apart, arcuately-shaped openings 59 are formed in the outer portion of ring 58 for movement with the ring 58 between a first position in which they are in alignment with openings 57 in the first ring, as shown in FIGS. 3 and 5, and a second position in which they are out of alignment therewith, as shown in FIG. 6.

Holes 59A are also formed in the ring 58 intermediate openings 59 for movement between a position above solid portions of ring 54, in the first position of openings 59, and a position above openings 59 in the second position thereof.

The openings 59 are of substantially the same width or radial extent as the openings 57, but are of somewhat greater circumferential extent. As shown, each ring has four openings, with adjacent openings in each ring being separated by a solid portion of the ring of somewhat greater circumferential extent than the openings. Also, and as best shown in FIG. 2A, the inner diameter of second ring 58 is spaced from spacer carried by the shaft so that normally ring 58 is not caused to rotate with the shaft. Thus, in the first position of ring 54, openings 59 provide unobstructed flow through the annular space. In the second position, however, openings 59A, which are of considerably smaller cross-sectional area than openings 57, restrict flow through such space, so as to cause an increase in the pressure of the drilling fluid. The same function may be obtained, of course, by arranging openings 57 and 59 in such a way that, in the second position of ring 58, portions of openings 57 overlap with portions of openings 59, so as to permit restricted flow through the turbine section and thus limit circulation of drilling fluid.

A sleeve 60 is carried about the skirt 44 by means of the threaded engagement of its upper end 61 to an upwardly extending neck on the skirt. More particularly, the sleeve is so connected to the skirt that a surface 62 on its lower end is spaced a short distance above a surface 63 on the upper end of ring 58. As previously described, the space between these surfaces determines the extent to which the axial bearing of the tool may wear before damage, and this space is vertically adjustable by means of the threaded connection 61. Preferably, the surfaces 62 and 63 are conically shaped so that the upper surface 62 has some freedom to bend outwardly and thus wedge tightly against surface 63 as it moves downwardly thereagainst upon wear of the bearings.

Ring 58 is normally held in its first position (FIGS. 3 and 5) with respect to the ring 54 by means of a shearable wire 65 which extends into the first and second rings. However, as the bearing wears to close the space between these surfaces, surface 62 will move into tight engagement with surface 63 and thereby cause ring 58 to rotate with the shaft, and thus move opening ring 58 from the first position of FIGS. 3 and 5 to the second position of FIG. 6. As previously described, this obstructs flow through the turbine section to cause an increase in back pressure in the drilling fluid, which increase may be detected by an operator at the surface.

The second ring 58 is prevented from moving beyond its second position by means of stops 66 mounted on the ledge of the ring 54 and received within openings 59 in the ring 58. When ring 58 is in its first unobstructing position, stops 66 are adjacent one end of openings 59 and, when the second ring is caused to move to its second position, the opposite end of opening 59 is moved into engagement with the stop 66.

Ring 58 is prevented from moving back from its second position to its first position by means of one or more pins 67 which are mounted within holes in the second rings 58 for vertical movement between a raised position (FIG. 4) in which their lower ends slide over the ledge of the ring 54, and a lowered position (not shown) in which their lower ends depend from the holes in the second rings as they drop into the openings 57 in the ledges of the first rings as the second rings move into their second positions. The relative positions of the pins 67 with respect to the first rings 54 will be seen from FIG. 6.

Sleeve 60 is locked in its vertically adjusted position with respect to skirt 44 by means of lock screws 68 threadedly received through the upper ends of the sleeve for bearing at their lower ends 69 on an upwardly facing surface about the neck of skirt 44. Thus, as well known in the art, the threads connecting screws 68 to the sleeve are of opposite hand to those connecting the sleeve to the skirt at 61. The upper ends of the threaded holes receiving screws 68 are closed by means of a cap 70 connected to the threaded opening through the neck of the skirt.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A well tool, comprising a body connectible as part of a well string and including inner and outer members which define an annular flow path between them through which fluid may be circulated, an axial thrust bearing carried by one member to support the other member for relative rotation with respect thereto, a first part carried by the one member for rotating therewith and having at least one opening therethrough which forms a continuation of the flow path between the members, a second part having at least one opening therethrough and mounted on the first part for relative rotation with respect thereto between a first position in which its opening is substantially aligned with the opening in the first part and a second position in which it is out of alignment therewith so as to obstruct flow throughout the flow path, a third part carried by the other member for rotation therewith and having a lower surface which is normally spaced above an upper surface on the second part a vertical distance less than the other member is free to move downwardly relatively to the one member upon wear of the bearing, so that, in response to a predetermined amount of wear to the bearing, the lower surface moves downwardly into engagement with said upper surface so as to cause said second part to rotate with said third part, and thereby permit relative rotation of said second part with respect to said first part from its first to its second position, and means for locating said second part in its second position automatically in response to its movement into said second position.

2. A well tool of the character defined in claim 1, wherein said locating means comprises a stop on the first part engageable with a stop on the second part to prevent relative rotation of the second part beyond its second position.

3. A well tool of the character defined in claim 2, wherein said locating means also comprises a pin carried by the second part in a position to drop into the opening in the first part, as second member rotates relatively into its second position, and thereby prevent relative rotation of the second member from its second to its first position.

4. A well tool of the character defined in claim 1, wherein the upper and lower surfaces are conically shaped so as to wedge against one another upon continued bearing wear.

5. A well tool of the character defined in claim 1, including releasable means initially locating the second part in its first position and being automatically releasable in response to relative rotation between the first and second parts following engagement of said upper and lower surfaces.

6. A well tool of the character defined in claim 5, wherein said releasable means comprises a shear pin connecting the first and second parts.

7. A well tool of the character defined in claim 1, wherein each of the first and second parts comprises a ring guidably rotatable within the annular space, each ring having a plurality of holes therein alignable with holes in the other ring.

8. A well tool of the character defined in claim 7, wherein the cross-sectional area through the holes in their first positions is approximately equal or greater than the smallest cross-sectional area of the remainder of the flow path.

9. A well tool is the character defined in claim 1, including means for adjusting the spacing between the upper and lower surface on the third and second parts.

10. A drilling motor, comprising a body connectible as a part of a well string including a housing adapted to be suspended from the lower end of the string and a shaft arranged within the housing to define an annular space therebetween and adapted to suspend a bit from its lower end, an axial thrust bearing carried by the housing to support the shaft for rotation with respect to the housing, a turbine section above the bearing having a series of stators carried by the housing for rotation therewith and stacked one above the other within the annular space, and a series of rotors carried by the shaft for rotation therewith and stacked one above the other within said space, with the rotor elements in alternating relation with the stator elements so that the shaft is caused to rotate in response to the flow of drilling fluid through said space, a first ring carried by the housing for rotation therewith and having circumferentially-spaced openings therethrough which form a continuation of the flow path through the annular space, a second ring mounted on the first ring for rotation with respect thereto and having circumferentially-spaced openings therethrough which are movable upon such rotation, between a first position in which the openings are substantially aligned with the openings in the first ring and a second position in which they are out of alignment therewith so as to obstruct flow through the annular space to substantially less than flow through the turbine section when the openings are in the first position, a part carried by the shaft for rotation therewith and having a lower surface which is normally spaced above an upper surface on the second ring a vertical distance less than the maximum vertical spacing between adjacent stator and rotor elements so that in response to a predetermined amount of wear on the bearing, the lower surface moves downwardly into engagement with said upper surface so as to cause said second ring to rotate with said part, and thereby permit rotation of said second ring with respect to said first ring from its first to its second position, and means for locating said second ring in its second position automatically in response to its movement into said second position.

11. A drilling motor of the character defined in claim 10, wherein said locating means comprises a stop on the upper side of first ring engageable with one end of an opening in the second ring to prevent rotation of the second ring beyond its second position.

12. A drilling motor of the character defined in claim 11, wherein said locating means also comprises a pin carried by the second ring in a position to drop into an opening in the first ring, as shaft rotates into its second position, and thereby prevent relative rotation of the shaft from its second to its first position.

13. A drilling motor of the character defined in claim 10, wherein said stators having outer walls which are stacked in end-to-end relation, and said first ring has an outer end wall whose lower end is stacked above the end wall of one of the stators, an inner wall spaced from the outer wall, and a ledge extending between the inner and outer walls and through which said openings are formed.

14. A drilling motor of the character defined in claim 13, wherein said locating means comprises a stop on the ledge of the ring which is received in one of the openings in the second ring, in the first position thereof, and which is engaged by one end of said opening to prevent rotations of the second ring beyond its second position.

15. A drilling motor of the character defined in claim 14, wherein said locating means also comprises a pin carried by the second ring for vertical movement between a raised position, in which its lower end is supported by the ledge of the first ring for sliding thereover, and a lowered position in which its lower end drops into an opening in the ledge as the second ring moves into its second position.

16. A drilling motor of the character defined in claim 10, wherein the upper and lower surfaces are conically shaped so as to wedge against one another upon continued bearing wear.

17. A drilling motor of the character defined in claim 10, including releasable means initially locating the second ring in its first position and being automatically releasable in response to rotation of said ring toward its second position following engagement of said upper and lower surfaces.

18. A drilling motor of the character defined in claim 17, wherein said releasable means comprises a shear pin connecting the first and second rings.

19. A drilling motor of the character defined in claim 10, wherein said part comprises a sleeve surrounding the shaft and threadedly connected thereto to permit the lower surface to be adjusted toward and away from the upper surface on the second ring.

20. A drilling motor of the character defined in claim 19, wherein said shaft comprises a main body about which the stators are stacked, and a skirt threadedly connected to the main body, the lower end of the skirt bearing on the upper end of the stack of stators, and the sleeve surrounding and being threadedly connected to the skirt, a screw carried by the sleeve for movement downwardly into engagement with a portion of the skirt to prevent vertical movement of the sleeve out of its adjusted position.

* * * * *